US009587835B2

(12) United States Patent
Hoffman

(10) Patent No.: US 9,587,835 B2
(45) Date of Patent: Mar. 7, 2017

(54) HOME APPLIANCE WITH IMPROVED GAS IGNITER

(71) Applicants: BSH Home Appliances Corporation, Irvine, CA (US); BSH Bosch und Siemens Hausgeräte GmbH, Munich (DE)

(72) Inventor: Jennifer A. Hoffman, Knoxville, TN (US)

(73) Assignees: BSH Hausgeräte GmbH, Munich (DE); BSH Home Appliances Corporation, Irvine, CA (US)

( * ) Notice: Subject to any disclaimer, the term of this patent is extended or adjusted under 35 U.S.C. 154(b) by 403 days.

(21) Appl. No.: 14/247,270

(22) Filed: Apr. 8, 2014

(65) Prior Publication Data

US 2015/0285511 A1 Oct. 8, 2015

(51) Int. Cl.

| | |
|---|---|
| ***F24C 3/10*** | (2006.01) |
| ***F23Q 7/10*** | (2006.01) |
| ***F24C 3/08*** | (2006.01) |

(52) U.S. Cl.

CPC ..... *F24C 3/103* (2013.01); *F23Q 7/10* (2013.01); *F24C 3/087* (2013.01)

(58) Field of Classification Search

CPC ..... F24C 3/103; F24C 3/087; F23Q 7/10

USPC ..... 431/263; 219/267

See application file for complete search history.

(56) References Cited

U.S. PATENT DOCUMENTS

| | | | | |
|---|---|---|---|---|
| 2,480,046 | A | 8/1949 | Reeves | |
| 4,029,936 | A * | 6/1977 | Schweitzer | F23Q 7/22 219/267 |
| 4,288,210 | A * | 9/1981 | Leonard | F23N 5/24 126/41 R |
| 5,216,990 | A * | 6/1993 | Moosmann | F02M 57/06 123/145 A |
| 5,511,973 | A | 4/1996 | Ray | |
| 6,854,438 | B2 | 2/2005 | Hilger et al. | |
| 6,935,328 | B2 | 8/2005 | Haynes et al. | |
| 2011/0086319 | A1 | 4/2011 | Chodacki et al. | |
| 2013/0081611 | A1 | 4/2013 | Cadima | |

FOREIGN PATENT DOCUMENTS

| | | |
|---|---|---|
| JP | S60194217 A | 10/1985 |
| JP | S62272024 A | 11/1987 |

* cited by examiner

*Primary Examiner* — Alfred Basichas

(74) *Attorney, Agent, or Firm* — Michael E. Tschupp; Andre Pallapies

(57) ABSTRACT

A home appliance having an improved gas igniter (or ignitor) including an appliance body, at least one burner assembly supported in the appliance body to provide a heat source for cooking, with the burner assembly including a gas pipe, an igniter in operational communication with the gas pipe, the igniter including a heater element and a shroud covering a portion of the heater element, the shroud including a shroud body defining a chamber having the heater element therein, an inlet opening facing the gas pipe, an outlet opening facing away from the gas pipe, and a constriction intermediate the inlet opening and the outlet opening, thereby defining a fluid flow path through the chamber whereby a fluid stream is directed from the inlet opening, across the heater element, through the constriction to the outlet opening.

24 Claims, 9 Drawing Sheets

HOME APPLIANCE WITH IMPROVED GAS IGNITER

BACKGROUND OF THE INVENTION

The present invention is related broadly to home appliances that employ a heat-generating apparatus and, more particularly, to home appliances that use gas burners as a controlled heat source.

Home appliances such as ranges and cooktops may use gas burners as a source of heat for cooking. Cooking appliances that may employ gas burners include freestanding ranges that include an oven and a cooktop as well as built-in, stand-alone, wall-mounted ovens. With respect to the present invention, references herein to ranges and built-in ovens may be used interchangablely and both may act as a platform for gas burner use. In addition, while the present application focuses on ranges and ovens, the invention described herein may have applicability with other appliances employing heat such as laundry dryers and the like.

Gas burners utilize a gas supply such as natural gas or propane mixed with air to provide a combustible gas/air mixture for ignition by a resistive heater element. A user-controlled valve throttles the amount of gas available for the burner to thereby control the amount of heat energy applied by the burner flame to an oven cavity to raise the temperature within the cavity to a predetermined level for cooking.

In general, a gas-fired oven burner operates when a user first starts the oven or when a hot oven drops below a predetermined temperature. There, a user control or a thermostat switches power to an igniter and a gas valve circuit which are connected in series. It should be noted that the term "igniter" may also be presented as "ignitor". Both spellings are valid and describe the same structure. As power flows through the igniter the current draw causes the igniter to produce heat. The igniter includes a resistive heater element joined to a base, usually ceramic, for mounting and connection to a power source. A heat shield or shroud keeps wiring and other undesirable matter away from the heater element.

Once the igniter draws a specific amount of current or achieves a pre-determined temperature; a gas valve opens to allow gas flow to the oven burner where the glowing hot igniter ignites the gas. Once the set temperature is achieved, the control stops all power to the ignition circuit which causes the igniter to dim and the oven gas valve to close thereby cutting off the burner flame. Cycling on and off continues in order to maintain the desired cooking temperature within the oven cavity.

Once the igniter is activated, it rapidly heats to glowing and the gas should light off quickly. However, with conventional shrouds such is not always the case.

As seen in FIGS. 7A and 8A, a prior shroud 100 includes a shroud body 102 that conforms generally to the base of the igniter and partially surrounds the heater element. The body 102 includes vented walls 104 having openings 106 formed therein to allow heat to escape from the igniter while still providing igniter protection. With reference to FIG. 8A, the heater element 110 is located generally centrally within the shroud 100 and partially surrounded by the vented walls 104. The entire assembly 100 is in operational communication with a gas pipe 32 to produce a flame F. It should be noted that a flame F is shown in FIG. 8A and FIG. 8B for clarity. It will be understood that gas is emitted from the pipe prior to ignition.

As the heater element 110 is heated, convection heat is emitted, as illustrated in FIG. 8A by rings C. Given the configuration of the shroud 100, air is effectively pushed away from the heater element 110 by convection action as the heat from the heater element 110 causes a general airflow away from the heater element 110. This convection flow can also cause the gas from the gas pipe 32 to be blown away from the heater element 110 thereby directing the gas into a region of the temperature field created by the heating element 110 that is at a lower temperature than areas closer to the heater element 110, and tending to disburse the gas, causing a lean gas/air mixture. Accordingly, lighting gas ignition for flame F production is delayed until the outer reaches of the temperature field created by the heating element 110 are hot enough to ignite the gas. This time can vary among individual igniters, but has taken as long as eight (8) seconds.

It is generally desirable to expect gas ignition within four (4) seconds or less after initiation of the ignition process. In addition, the Canadian Standards Association requires ignition within four (4) seconds or less before an appliance can be listed for sale in Canada. Prompt ignition is required to prevent accumulation of gas within the oven cavity which could prove dangerous. In addition to the initial heating of the oven, an unduly long wait for gas ignition can affect oven temperature stability and control, which can have a detrimental effect on appliance efficiency.

Accordingly, there exists a need for a gas igniter to counter the tendency of convection heat to move gas away from the igniter. There also exists a need to incorporate such structure into the existing structure of the burner assembly and more particularly, in an igniter shroud.

SUMMARY OF THE INVENTION

It is accordingly the intention of the present invention to provide a home appliance with an improved igniter, and an improved igniter that will ignite a cooking flame in a short amount of time, preferably within four seconds or less after gas becomes available.

It is another object of the present invention to provide a home appliance with an improved igniter, and an improved igniter that will draw gas toward the heater element of the igniter to enhance the ability of the heater to rapidly ignite a cooking flame.

To those ends, the present invention is directed to a home appliance having an improved gas igniter. The home appliance includes an appliance body and at least one burner assembly supported in the appliance body to provide a heat source for cooking. The burner assembly includes a gas pipe and an igniter in operational communication with the gas pipe. The igniter includes a heater element and a shroud covering a portion of the heater element. The shroud includes a shroud body defining a chamber having the heater element therein, an inlet opening facing the gas pipe, an outlet opening facing away from the gas pipe, and a constriction intermediate the inlet opening and the outlet opening, thereby defining a fluid flow path through the chamber whereby a fluid stream is directed from the inlet opening, across the heater element, through the constriction to the outlet opening.

Preferably, the shroud body has two converging walls extending toward the constriction and two outlet walls extending away from the constriction. It is further preferred that the two outlet walls diverge to form a flared passageway defining a flue along the fluid flow path.

Preferentially, the igniter includes a base portion and the shroud body has an elongate generally rectangular portion with the converging walls extending along a long axis of the shroud body.

It is preferred that the constriction is in a corner of the elongate generally rectangular portion of the shroud body and the outlet walls extend from end portions of the converging walls.

A home appliance according to claim 1 wherein a portion of the shroud body is preferably juxtaposed with a base portion of the igniter.

The constriction preferably forms throat of a nozzle and the shroud body preferably has two converging walls extending toward the constriction and two outlet walls extending away from the constriction, whereby the shroud body forms a convergent/divergent nozzle.

It is further preferred that the constriction is intermediate joined portions of the converging walls.

The present invention can also be in the form of a gas igniter for a home appliance having least one burner assembly supported in the appliance body to provide a heat source for cooking. There, the gas igniter includes a heater element in operational communication with a gas pipe and a shroud covering a portion of the heater element. The shroud includes a shroud body defining a chamber having the heater element therein, an inlet opening facing the gas pipe, an outlet opening facing away from the gas pipe, and a constriction intermediate the inlet opening and the outlet opening, thereby defining a fluid flow path through the chamber whereby a fluid stream is directed from the inlet opening, across the heater element, through the constriction to the outlet opening.

Preferably, the shroud body has two converging walls extending toward the constriction and two outlet walls extending away from the constriction. The two outlet walls preferably diverge to form a flared passageway defining a flue along the fluid flow path.

It is further preferred that the igniter includes a base portion and the shroud body has a elongate generally rectangular portion with the converging walls extending along a long axis of the shroud body.

Preferentially, the constriction is in a corner of the elongate generally rectangular portion of the shroud body and the outlet walls extend from end portions of the converging walls.

Preferably, a portion of the shroud body is juxtaposed with a base portion of the igniter.

It is preferred that the constriction forms a throat of a nozzle and the shroud body has two converging walls extending toward the constriction and two outlet walls extending away from the constriction, whereby the shroud body forms a convergent/divergent nozzle.

Preferably, the constriction is intermediate joined portions of the converging walls.

By the above, the present invention provides a straightforward device that can be economically manufactured. Further, the present invention enhances safety during gas ignition and provides improved oven temperature stability and control.

DESCRIPTION OF THE PREFERRED EMBODIMENT

Figure 1:
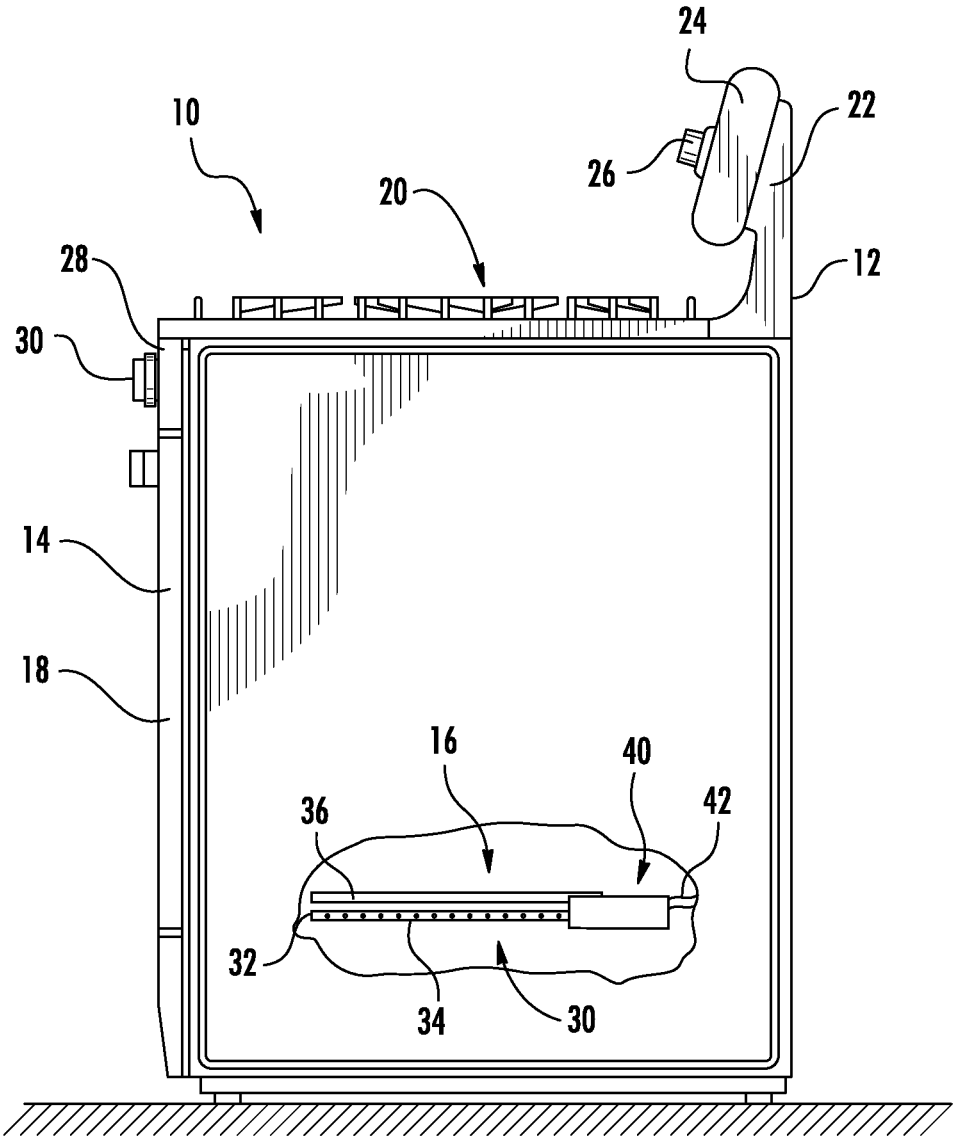
FIG. 1 is a side view of a home appliance in the form of a range according to the preferred embodiment of the present invention.

Turning now to the drawings and, more particularly to FIG. 1, a home appliance in the form of a range is illustrated generally at 10 and includes a generally rectangular, floor-standing range body 12 housing an oven 14 and a cooktop 20. The oven 14 defines an internal oven cavity 16 for cooking covered by an access door 18. The cooktop 20 is above the oven and provides a generally horizontal cooking surface. A vertically oriented backsplash 22 extends upwardly from the rear portion of the cooktop 20 and a first control panel 24 with an oven control 26 is mounted to the backsplash 22. A second control panel 28 extends downwardly from the front portion of the cooktop 20 toward the oven 14. A series of control knobs 30 is arranged linearly across the second control panel 28 and is provided for cooktop burner control.

FIG. 1 is shown broken open to illustrate the general location of the present invention within the oven cavity 16. There, the burner assembly 30 is located near the base of the oven and is in fact underneath a panel that forms the bottom wall of the oven cavity 16. The burner includes an elongate gas pipe 32 that is perforated with gas distribution holes 34. A generally planar heat distributor 36 is disposed above the gas pipe 32 to receive heat from flames emitted from the gas pipe 32 and to distribute the heat within the oven cavity 16 for cooking purposes. An igniter 40 is shown in block form attached to an end portion of the gas pipe 32, as will be seen in greater detail hereinafter, and is in electrical communication with the range power supply using electrical wiring 42.

Figure 2:
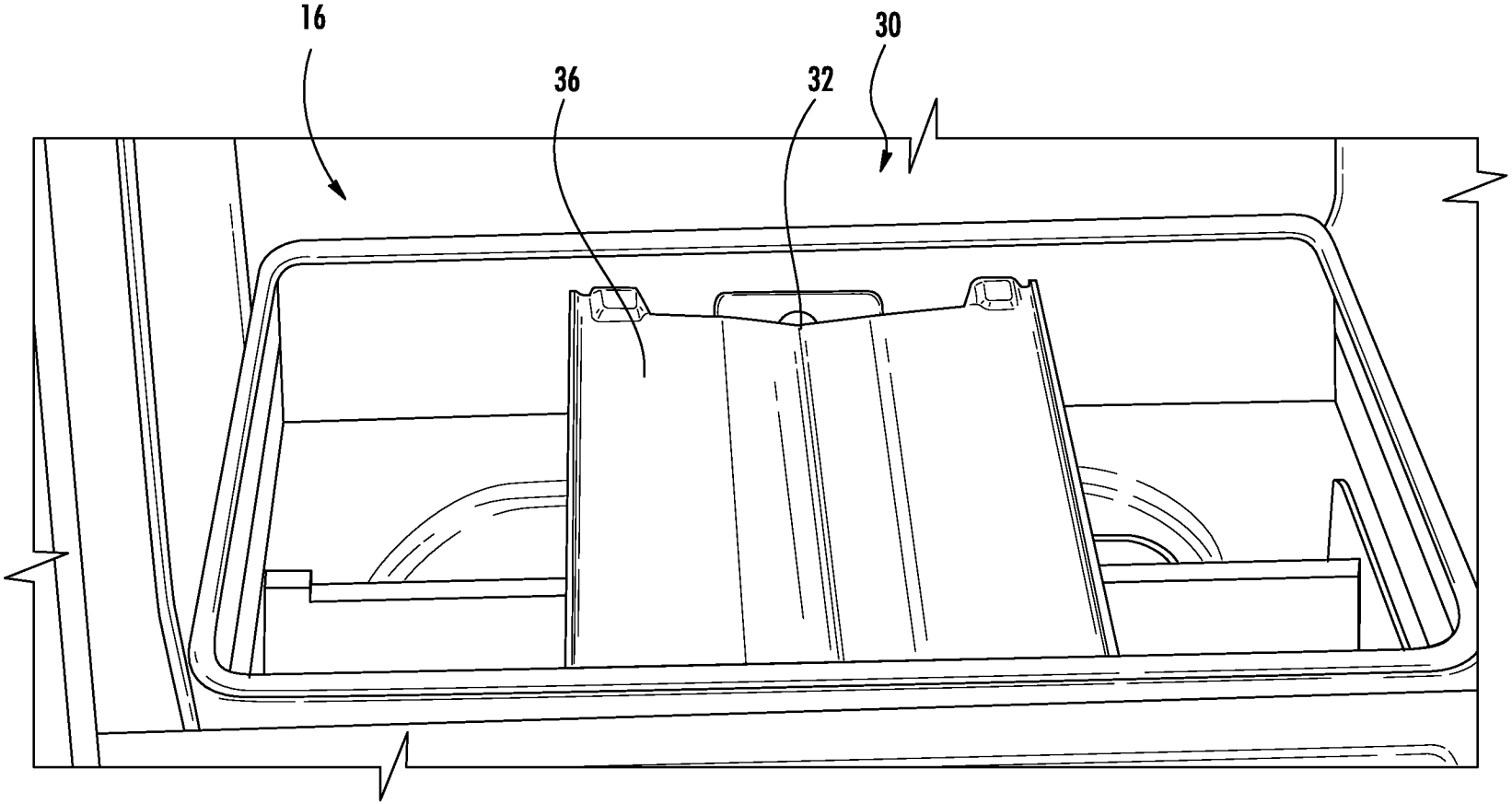
FIG. 2 is a perspective view of the oven cavity illustrating the location of the gas burner assembly.

Turning now to FIG. 2, the oven cavity 16 includes a well in which the burner assembly 30 resides. The well is illustrated uncovered in FIG. 2 to display the burner assembly 30. During oven use, the well is covered with a generally planar panel (not shown) to separate the burner assembly 30 from the interior of the oven cavity 16. The gas pipe 32 extends from back to front with respect to the oven cavity 16. The heat distributor 36 is centered over the gas pipe and is formed in a shallow V-shape for proper heat distribution.

Figure 3:
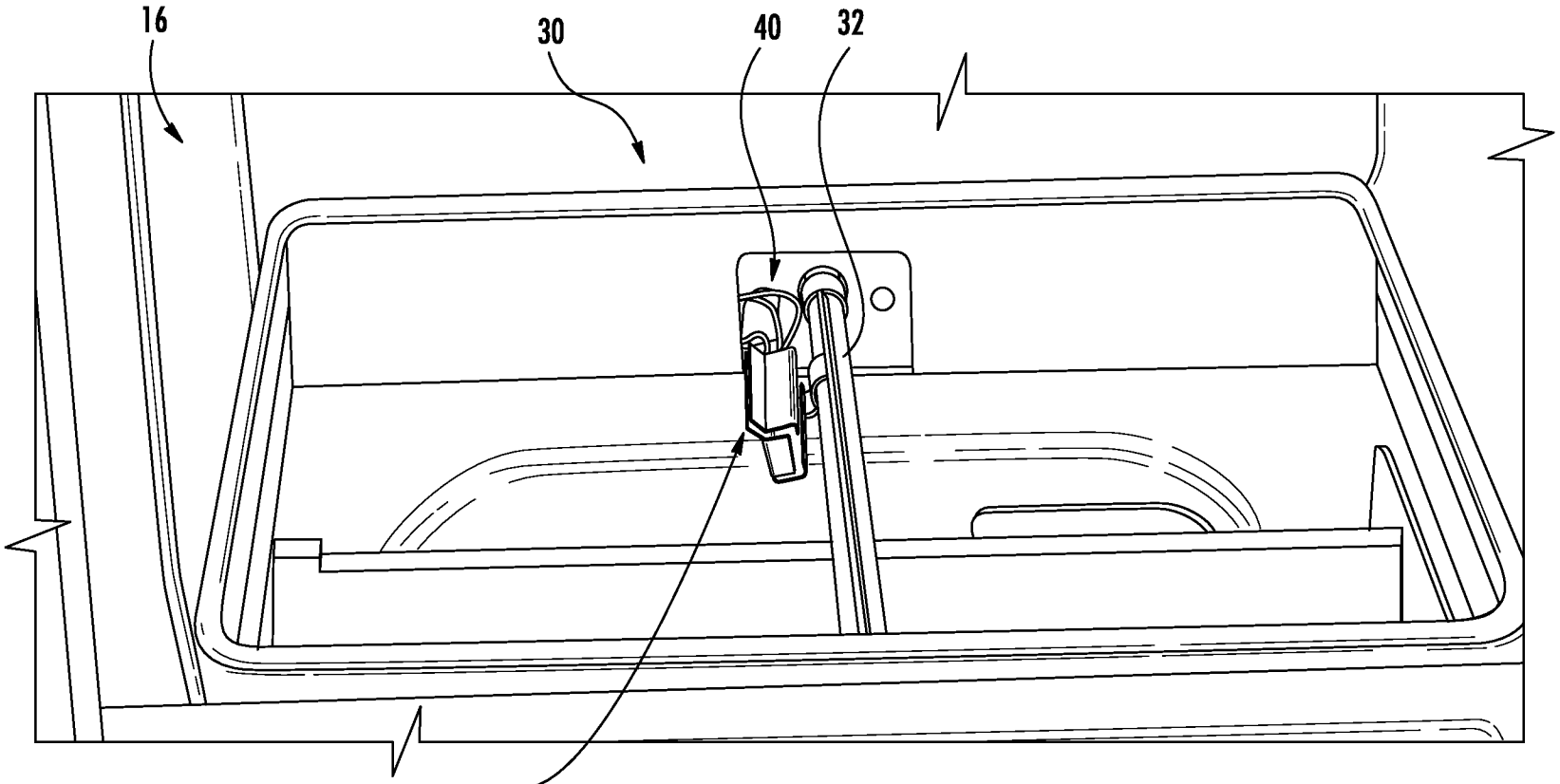
FIG. 3 is a perspective view of the oven cavity illustrating the location of the gas pipe and igniter.

FIG. 3 illustrates the gas burner assembly 30 with the heat distributor 36 removed. Accordingly, the relationship between the igniter 40 and the gas pipe 32 is displayed, with the igniter 40 extending in a generally parallel manner with the gas pipe 32. The igniter 40 includes a shroud 50 according to the preferred embodiment of the present invention. The structure of the present igniter shroud 50 will be discussed in greater detail hereinafter.

Figure 4:
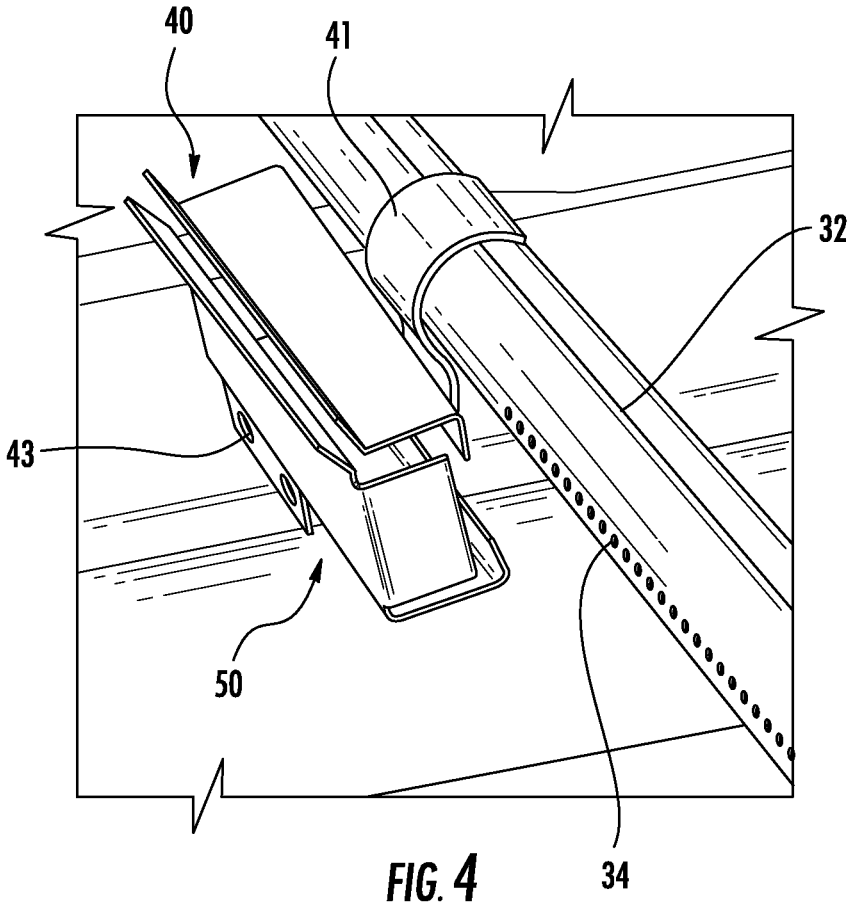
FIG. 4 is a perspective view of the gas pipe and igniter illustrated in FIG. 4.

Turning now to FIG. 4, the igniter 40 includes a shroud 50 according to the present invention and is mounted adjacent or directly to the gas pipe 32 across from the gas delivery openings 34. The igniter 40 may be mounted to the gas pipe 32 in one of several different ways using the shroud 50. FIG. 4 shows a bracket 41 that wraps around the pipe 32 and connects to the shroud 50. Another bracket 43 may provide a different mounting location. Due to the relationship between the igniter 40 and the gas pipe 32, gas from the gas pipe 32 is directed toward the igniter 40.

Figure 5:
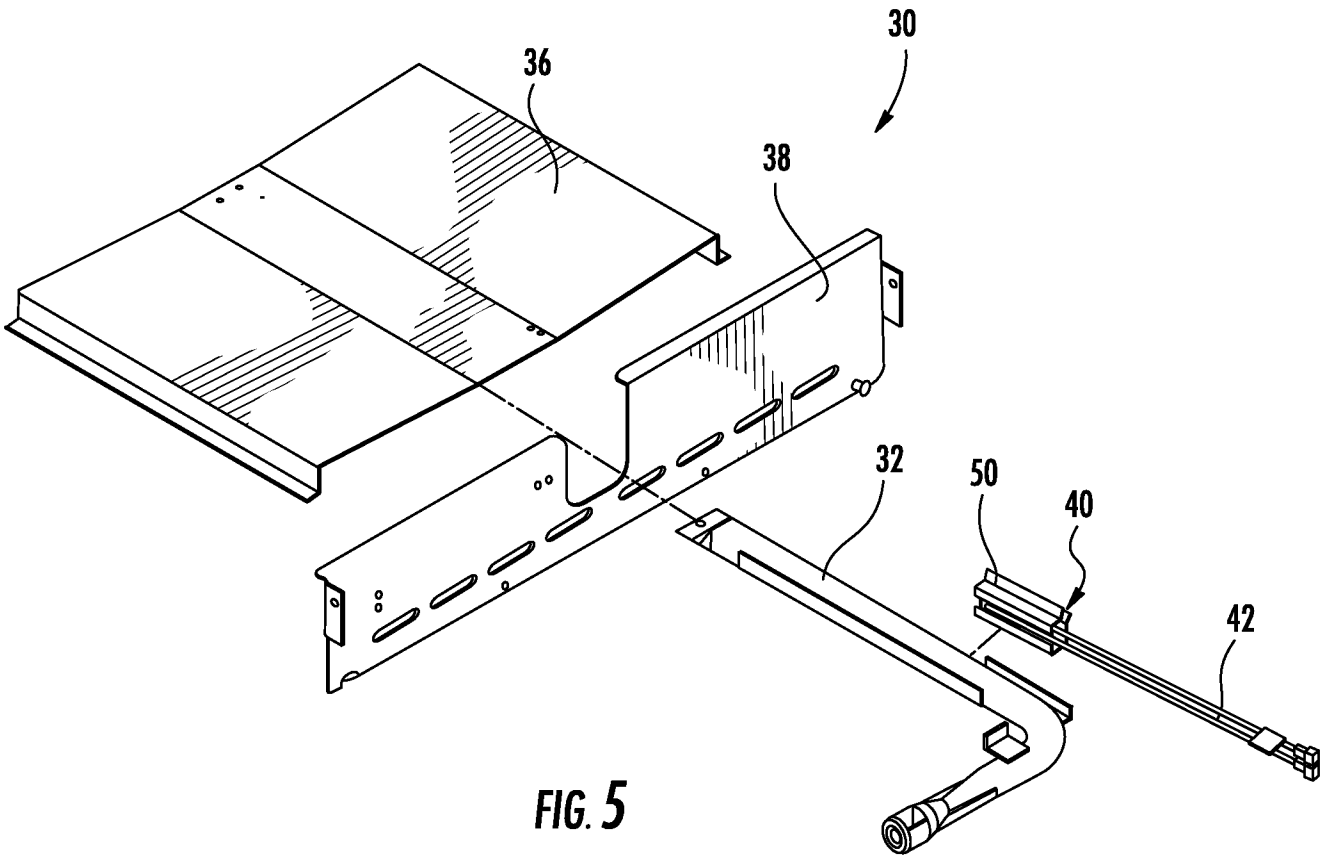
FIG. 5 is an exploded view of the gas pipe and igniter assembly.

FIG. 5 illustrates of the gas burner assembly 30 exploded to show the basic burner parts in their entirety. These parts include the L-shaped gas pipe 32 along with the igniter 40 including the shroud 50 and electrical wiring 42. Proceeding inwardly from the gas pipe 32, a vertical bracket 38 is provided to mount the gas burner assembly 30 to the walls within the oven cavity (not shown in FIG. 5). Finally, the heat distributor 36 is positionable over the gas pipe to evenly distribute the heat produced by the flame within the oven cavity, as described above.

Figure 6:
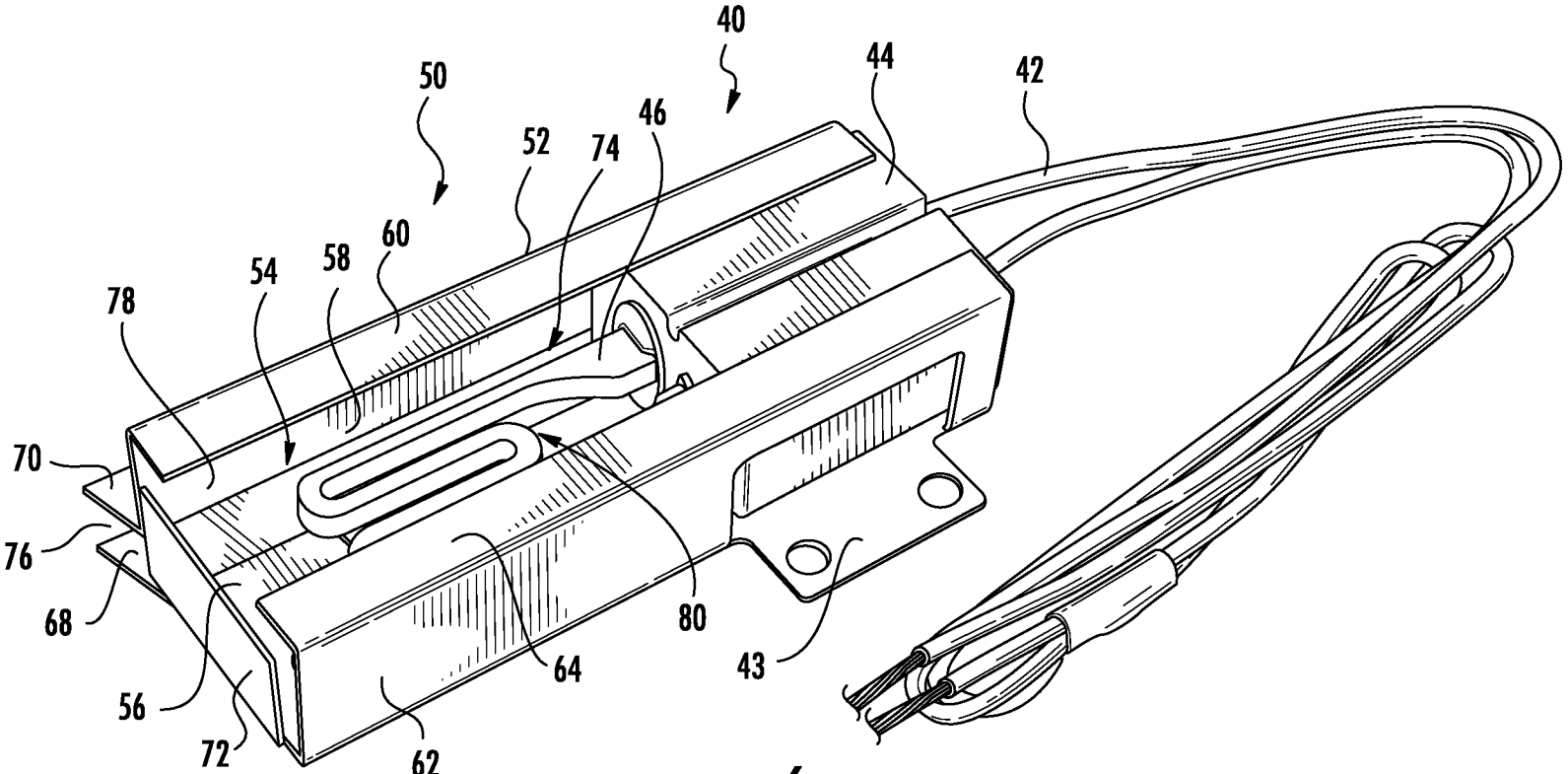
FIG. 6 is a perspective view of an igniter according to the preferred embodiment of the present invention.

Turning now to FIG. 6, the igniter 40 includes a resistive heater element 46 formed in a serpentine manner and inserted in a ceramic base 44. The base 44 is generally rectangular. Power is supplied to the resistive heater element 46 through electrical wiring 42. The shroud 50 forms a cavity 54 that is configured for telescopic receipt of the base 44 with the elongated shroud body extending far enough away from the base to contain the heating element 46.

The shroud 50 defines a working area for the resistive heating element 46, and, as will be discussed in greater detail hereinafter, a fluid flow path 80 across the heater element 46. The shroud 50 is configured and positioned to receive sufficient gas from the gas pipe 32 (not shown in FIG. 6) so that the resistive heater element 46 can ignite the gas being emitted from the gas pipe 32 to produce a flame for heat distribution by the heat distributor 36 and ultimate heating of the oven.

Continuing with reference to FIG. 6, the shroud 50 has a generally rectangular shroud body 52 that includes a planar back wall 56 extending the length of the shroud body 52. The back wall 56 forms a first converging wall that converges toward an imaginary junction with a second converging wall 58, wherein both the back wall 56 and the second converging wall 58 are terminated before they meet. At the other end of the second converging wall 56, a flange 60 projects approximately 90 degrees away therefrom and partially overrides the base 44 of the igniter 40. A side wall 62 projects upwardly approximately 90 degrees away from the back wall 56 and parallels the second converging wall 58, terminating in a flange 64. The flange 64 projects away from the side wall 62 at approximately a 90 degree angle and partially overrides the base 44 of the igniter 40 at a position oppositely from the other flange 60. An inlet opening 74 is defined between the edges of the flanges 60, 64 for entry of air and gas into the cavity 54.

An end wall 72 is formed from the material of the back wall and 56 and projects away therefrom at approximately 90 degrees. Optionally, a mounting bracket 43 may be formed from material of the side wall 62 and bent to extend away from the side wall 62 in a manner planar with the back wall 56.

A first outlet wall 68 extends outwardly from the back wall 56 in a manner that is not coplanar therewith. Similarly, a second outlet wall 70 extends away from the second converging wall 58 at an angle that is not coplanar therewith. A passageway for fluid flow is thereby formed between the first outlet wall 58 and the second outlet wall 70. The terminus of the outlet walls 68, 70 forms the outlet opening 76 for the shroud 50 at the end of the fluid flow path defined by the shroud 50. The outlet walls, 68, 70 preferably diverge, but may also extend in a parallel manner. Together, the outlet walls 68, 70 form a flue.

The back wall 56 and the converging wall 58 extend along planes that are approximately 90 degrees to one another yet never meet. The gap between the back wall 56 and the converging wall 58 forms a constriction 78 in the fluid flow path 80.

The shroud 50 thereby defines the fluid flow path 80 extending from the inlet opening 74 across the resistive heater element 46, through the constriction 78, away from the constriction 78 intermediate the outlet walls 68 and 70 and, finally, out through the outlet opening 76. Further, the back wall 56, acting as a first converging wall, the second converging wall 58, the constriction 78 and the two outlet walls 68, 70 together form a converging/diverging nozzle with the constriction 78 acting as a throat.

Figure 7A:
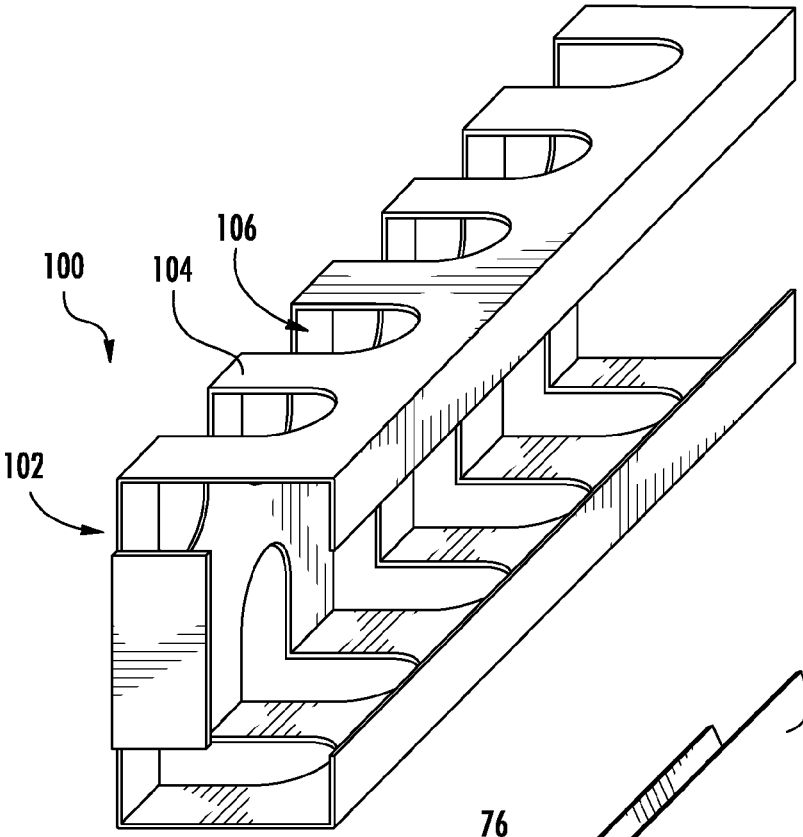
FIG. 7A PRIOR ART
FIG. 7A is a perspective view of a prior art igniter shroud.
Figure 7B:
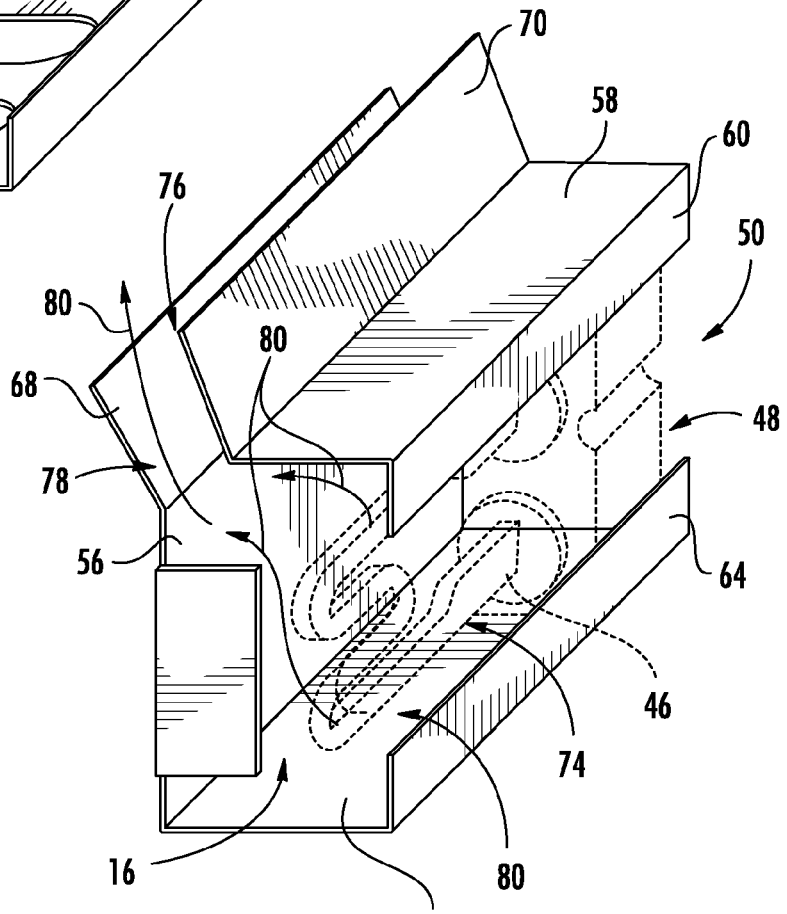
FIG. 7B is a perspective view of an igniter shroud according to the present invention.

Turning now to FIG. 7B, the fluid flow path through the shroud 50 is illustrated by arrows 80. The generally rectangular shape of the shroud 50 allows flanges 60, 64 to project away from the second converging wall 58 and the sidewall 62 to thereby define the inlet opening 74. The heating element, illustrated in phantom at 46, extends into the cavity 16 from the open end 48 of the shroud 50 and sits adjacent the inlet opening 74. The fluid flow path 80 is defined by the back wall 56 and the second converging wall 58, the constriction 78 located at one corner of the generally rectangular shroud 50, and the outlet walls 68, 70 projecting away from the back wall 56 and the second converging wall 58 at the constriction 78, terminating at the outlet 76. Accordingly, the gas/air mixture enters the inlet opening 74 to start along the fluid flow path 80. From the inlet opening 74 the gas/air mixture flows across the heater element 46. The gas/air mixture is guided toward the constriction 78 by the converging walls 56, 58 and exits the chamber 16 through the constriction 78. From there, the gas/air mixture flows outwardly toward the outlet opening 76 along a path between the outlet walls 68, 70 until ignition.

Figure 8B:
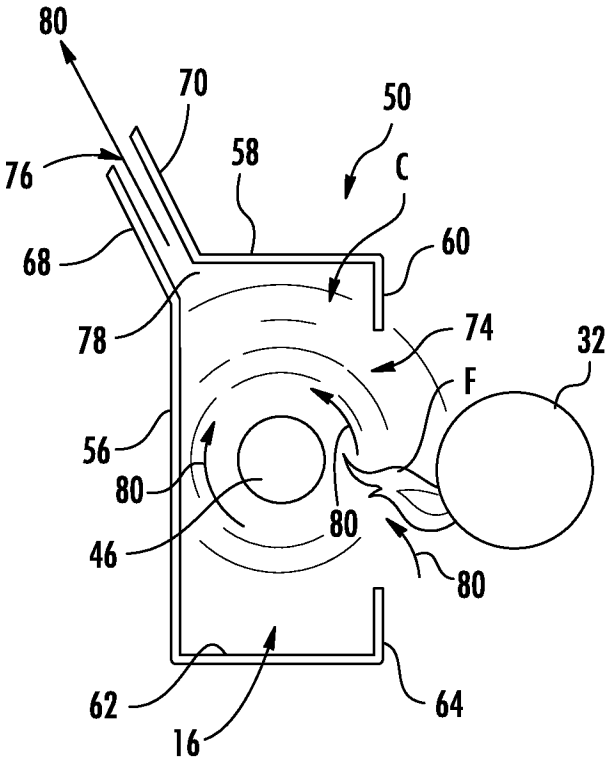
FIG. 8B is a diagrammatic end view of an igniter and shroud according to the preferred embodiment of the present invention.

In operation, and with reference to FIG. 8B, the heater element 46 is activated and heats the air within the chamber 16. As the air turns hotter closer to the heater element 46, convection, illustrated by convection lines C, causes airflow away from the heater element 46. Heated air at the constriction 78 creates a low pressure region and air is thereby drawn from the inlet opening 74 along with gas being emitted from the gas pipe 32, thereby forming the gas/air mixture for ignition and combustion.

Convection-driven fluid flow is then established wherein gas and air are drawn through the inlet 74, across the heater element 46, outwardly through the passageway or flue intermediate the outlet walls 68, 70 and ultimately through the outlet opening 76. Accordingly, the gas/air mixture is drawn into a region of higher temperature closer to the heater element 46 and therefore, ignition occurs sooner than it would occur in a prior appliance as hereinbefore discussed with reference to FIG. 8A.

Figure 8A:
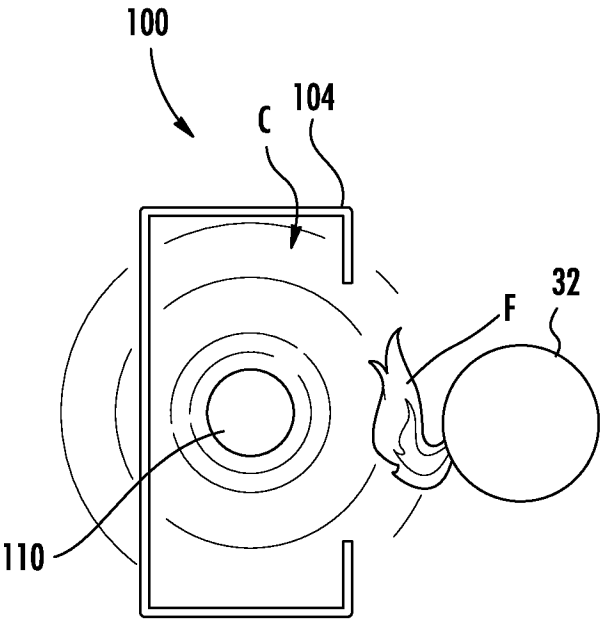
FIG. 8A PRIOR ART
FIG. 8A is a diagrammatic end view of a prior art igniter and shroud.

Accordingly, the present igniter can ignite the gas in less than four (4) seconds which the current igniter as illustrated in FIG. 8A cannot light the gas in less than four (4) seconds. Therefore, the present home appliance with the improved igniter can operate more efficiently by using less gas and bringing the oven to temperature sooner than with prior igniters. Further, safety is enhanced since the chance of unburned gas collecting within the oven cavity is reduced.

Figure 9:
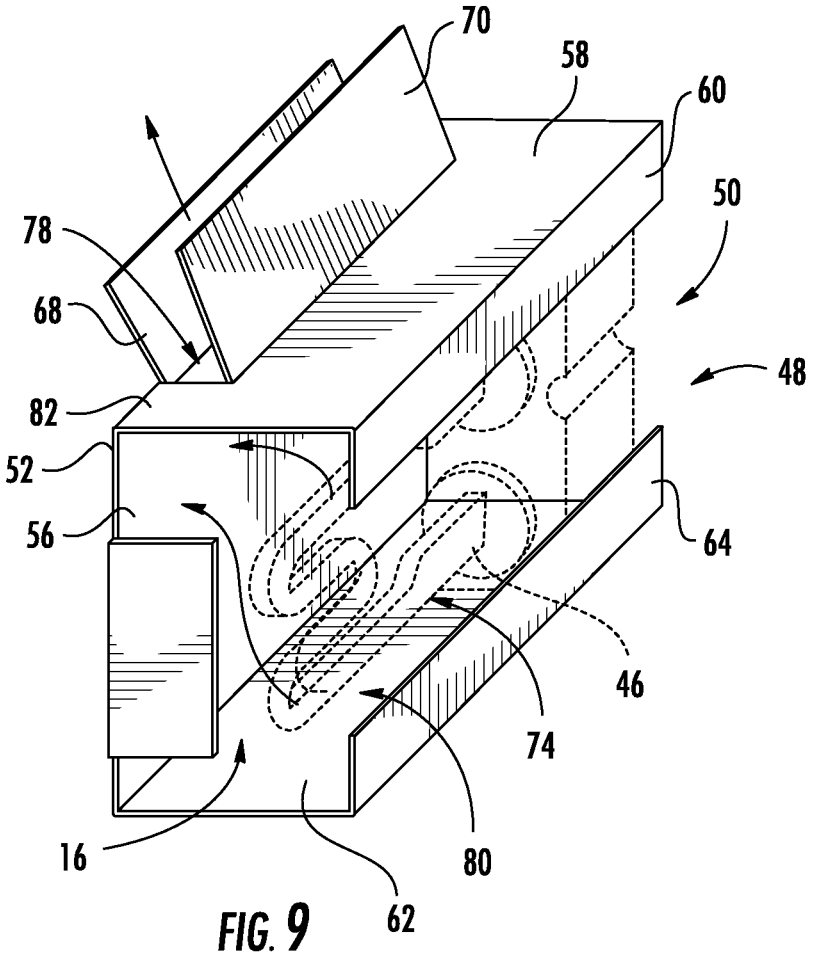
FIG. 9 is a perspective view of an igniter shroud according a second preferred embodiment of the present invention.

The shroud 50 may be constructed from two or more separate pieces, each with its own mounting arrangement, or it can be formed from a single sheet blank. In either case, the preferred material is some form of metal. As seen in FIG. 9, formation of the shroud 50 from a single sheet blank results in outer walls 68, 70 that extend outwardly a distance equal to one-half the width of the constriction 78 and do not extend longitudinally the full length of the shroud body 52. Accordingly, the back wall 56 and the second converging wall 58 are joined by junction portions 82 at either end of the shroud 50. Optionally, such joined portions 82 could be placed anywhere along the shroud body 52 with multiple outlet walls projecting away from the respective back wall 56 and converging wall 58. For maximum nozzle effect, it is preferable that the constriction 78 extend at least the length of the heater element 46 at a position adjacent to heater element 46. Optionally, a number of small flues may be formed by a number of outlet walls with multiple individual constrictions and multiple joined portions of the converging walls. Finally, using multiple components, virtually any shape can be applied to the shroud between the inlet opening and outlet opening, provided the characteristics of a converging/diverging nozzle are achieved.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

I claim:

1. A home appliance having an improved gas igniter comprising:

an appliance body; and at least one burner assembly supported in the appliance body to provide a heat source for cooking, the burner assembly including a gas pipe, an igniter in operational communication with the gas pipe, the igniter including a heater element and a shroud covering a portion of the heater element, the shroud including a shroud body defining a chamber having the heater element therein, an inlet opening facing the gas pipe, an outlet opening facing away from the gas pipe, and a constriction intermediate the inlet opening and the outlet opening, thereby defining a fluid flow path through the chamber whereby a fluid stream is directed from the inlet opening, across the heater element, through the constriction to the outlet opening, wherein the shroud body has two converging walls extending toward the constriction and two outlet walls extending away from the constriction and downstream of the constriction, and wherein the heater element is disposed upstream of the constriction.

2. A home appliance according to claim 1 wherein the two outlet walls diverge to form a flared passageway defining a flue along the fluid flow path.

3. A home appliance according to claim 1 wherein the igniter includes a base portion and the shroud body has a elongate generally rectangular portion with the converging walls extending along a long axis of the shroud body.

4. A home appliance according to claim 1 wherein the constriction is in a corner of the elongate generally rectangular portion of the shroud body and the outlet walls extend from end portions of the converging walls.

5. A home appliance according to claim 1 wherein a portion of the shroud body is juxtaposed with a base portion of the igniter.

6. A home appliance according to claim 1 wherein the constriction forms a throat of a nozzle.

7. A home appliance according to claim 1 wherein the constriction forms a throat of a nozzle and wherein the shroud body has two converging walls extending toward the constriction and two outlet walls extending away from the constriction, whereby the shroud body forms a convergent/divergent nozzle.

8. A home appliance according to claim 1 wherein the constriction is intermediate joined portions of the converging walls.

9. A home appliance according to claim 1, wherein a first converging wall of the two converging walls is arranged substantially perpendicular to a second converging wall of the two converging walls.

10. A home appliance according to claim 9, wherein an end of a first converging wall of the two converging walls is adjacent to an end of a second converging wall of the two converging walls, and wherein the constriction is formed between the end of the first converging wall and the end of the second converging wall.

11. A home appliance according to claim 1, wherein an end of a first converging wall of the two converging walls is adjacent to an end of a second converging wall of the two converging walls, and wherein the constriction is formed between the end of the first converging wall and the end of the second converging wall.

12. A home appliance according to claim 11, wherein a first outlet wall of the two outlet walls extends from the end of the first converging wall in a manner that is not coplanar with the first converging wall, and a second outlet wall of the two outlet walls extends from the end of the second converging wall in a manner that is not coplanar with the second converging wall.

13. A home appliance according to claim 11, further comprising:

a first sidewall extending from another end of the first converging wall; and a second sidewall extending from another end of the second converging wall, wherein the second sidewall includes the inlet opening, and wherein the first converging wall, the second converging wall, the first sidewall, and the second sidewall define the chamber having the heater element therein.

14. A home appliance according to claim 13, wherein the second sidewall is formed by a first flange extending from the first sidewall and a second flange extending from the another end of the second converging wall, and wherein the inlet opening is between the first flange and the second flange.

15. A home appliance according to claim 1, wherein the first outlet wall is parallel to the second outlet wall.

16. A gas igniter for a home appliance having least one burner assembly supported in the appliance body to provide a heat source for cooking, the gas igniter comprising:

a heater element in operational communication with a gas pipe and a shroud covering a portion of the heater element, the shroud including a shroud body defining a chamber having the heater element therein, an inlet opening facing the gas pipe, an outlet opening facing away from the gas pipe, and a constriction intermediate the inlet opening and the outlet opening, thereby defining a fluid flow path through the chamber whereby a fluid stream is directed from the inlet opening, across the heater element, through the constriction to the outlet opening, wherein the shroud body has two converging walls extending toward the constriction and two outlet walls extending away from the constriction and downstream of the constriction, and wherein the heater element is disposed upstream of the constriction.

17. A gas igniter according to claim 16 wherein the two outlet walls diverge to form a flared passageway defining a flue along the fluid flow path.

18. A gas igniter according to claim 16 wherein the igniter includes a base portion and the shroud body has a elongate generally rectangular portion with the converging walls extending along a long axis of the shroud body.

19. A gas igniter according to claim 16 wherein the constriction is in a corner of the elongate generally rectangular portion of the shroud body and the outlet walls extend from end portions of the converging walls.

20. A gas igniter according to claim 16 wherein a portion of the shroud body is juxtaposed with a base portion of the igniter.

21. A gas igniter according to claim 16 wherein the constriction forms a throat of a nozzle.

22. A gas igniter according to claim 16 wherein the constriction forms a throat of a nozzle and whereby the shroud body forms a convergent/divergent nozzle.

23. A gas igniter according to claim 16 wherein the constriction is intermediate joined portions of the converging walls.

24. A home appliance having an improved gas igniter comprising:

an appliance body; and at least one burner assembly supported in the appliance body to provide a heat source for cooking, the burner assembly including a gas pipe, an igniter in operational communication with the gas pipe, the igniter including a heater element and a shroud covering a portion of the heater element, the shroud including a shroud body defining a chamber having the heater element therein, an inlet opening facing the gas pipe, an outlet opening facing away from the gas pipe, and a constriction intermediate the inlet opening and the outlet opening, thereby defining a fluid flow path through the chamber whereby a fluid stream is directed from the inlet opening, across the heater element, through the constriction to the outlet opening, wherein the shroud body has two converging walls extending toward the constriction and two outlet walls extending away from the constriction, wherein the two outlet walls diverge to form a flared passageway defining a flue along the fluid flow path, and wherein the constriction is intermediate joined portions of the converging walls.

* * * * *